US011029109B2

(12) United States Patent
Golan

(10) Patent No.: US 11,029,109 B2
(45) Date of Patent: Jun. 8, 2021

(54) VARIABLE-LENGTH CORNER SHOOTING ASSEMBLY

(71) Applicant: CORNER SHOT (ISRAEL) LTD., Or Yehuda (IL)

(72) Inventor: Amos Golan, Ramat Gan (IL)

(73) Assignee: Corner Shot (Israel) Ltd., Or Yehuda (IL)

( * ) Notice: Subject to any disclaimer, the term of this patent is extended or adjusted under 35 U.S.C. 154(b) by 0 days.

(21) Appl. No.: 16/970,703

(22) PCT Filed: Feb. 17, 2019

(86) PCT No.: PCT/IL2019/050189
§ 371 (c)(1),
(2) Date: Aug. 18, 2020

(87) PCT Pub. No.: WO2019/159177
PCT Pub. Date: Aug. 22, 2019

(65) Prior Publication Data

US 2020/0378706 A1 Dec. 3, 2020

(30) Foreign Application Priority Data

Feb. 19, 2018 (IL) ..... 257602

(51) Int. Cl.
*F41C 23/04* (2006.01)
*F41A 11/06* (2006.01)
*F41C 23/12* (2006.01)

(52) U.S. Cl.
CPC ..... *F41A 11/06* (2013.01); *F41C 23/04* (2013.01); *F41C 23/12* (2013.01)

(58) Field of Classification Search
CPC ..... F41C 23/04; F41C 23/14; F41C 23/12; F41A 11/00; F41A 11/02; F41A 11/04; F41A 11/06
USPC ..... 42/1.11, 71.01, 75.03, 73, 72, 71.02; 89/41.05, 37.16
See application file for complete search history.

(56) References Cited

U.S. PATENT DOCUMENTS 1,184,078 A * 5/1916 Cooke ..... F41G 1/40 42/118
1,195,055 A * 8/1916 McNeal ..... F41G 1/41 89/37.04

(Continued)

FOREIGN PATENT DOCUMENTS

EP 1296111 A1 * 3/2003 ..... F41A 21/00
KR 101157823 6/2012
WO 2004/015355 2/2004

OTHER PUBLICATIONS

PCT Search Report and Written Opinion PCT/IL2019/050189, dated May 2, 2019.

*Primary Examiner* — John Cooper
(74) *Attorney, Agent, or Firm* — Dekel Patent Ltd.; David Klein

(57) ABSTRACT

An assembly (10) includes a receiver body (12) that includes a butt (14), a body trigger (16), a grip (18), and a display screen (20). A variable-length shaft (24) extends from a front portion of the receiver body (12). A firearm receiver member (36) is coupled to a distal end of the variable-length shaft (24) by means of a coupling device (42), and a camera (40) is in communication with, and is configured to send images to, the display screen (20).

8 Claims, 1 Drawing Sheet

(56) References Cited

U.S. PATENT DOCUMENTS

| | | | | | |
|---|---|---|---|---|---|
| 1,269,178 | A * | 6/1918 | Hamilton | F41G 1/40 | 356/254 |
| 1,300,688 | A * | 4/1919 | Bellard | F41G 1/40 | 42/118 |
| 3,262,440 | A * | 7/1966 | Kuhn | F41B 11/51 | 124/67 |
| 4,878,305 | A * | 11/1989 | Gabrielidis | F41A 19/09 | 42/72 |
| 5,628,137 | A * | 5/1997 | Cortese | F41C 27/06 | 42/105 |
| 6,543,173 | B1 * | 4/2003 | Golan | F41A 19/09 | 42/75.04 |
| 6,598,329 | B1 * | 7/2003 | Alexander | F41C 23/04 | 42/114 |
| 7,437,847 | B1 * | 10/2008 | Mabry | F41C 23/04 | 42/71.02 |
| 7,552,557 | B1 * | 6/2009 | Mabry | F41A 11/04 | 42/71.01 |
| 10,309,745 | B2 * | 6/2019 | Messinger | F41A 27/18 | |
| 10,619,976 | B2 * | 4/2020 | Peel | H04N 5/2253 | |
| 10,801,800 | B1 * | 10/2020 | Chia | F41C 23/04 | |
| 2004/0144010 | A1 * | 7/2004 | Golan | F41C 23/04 | 42/72 |
| 2005/0115140 | A1 * | 6/2005 | Little | F41C 23/04 | 42/118 |
| 2009/0064979 | A1 * | 3/2009 | Andrews | F41B 11/89 | 124/65 |
| 2016/0018184 | A1 * | 1/2016 | Park | F41C 23/20 | 42/73 |

* cited by examiner

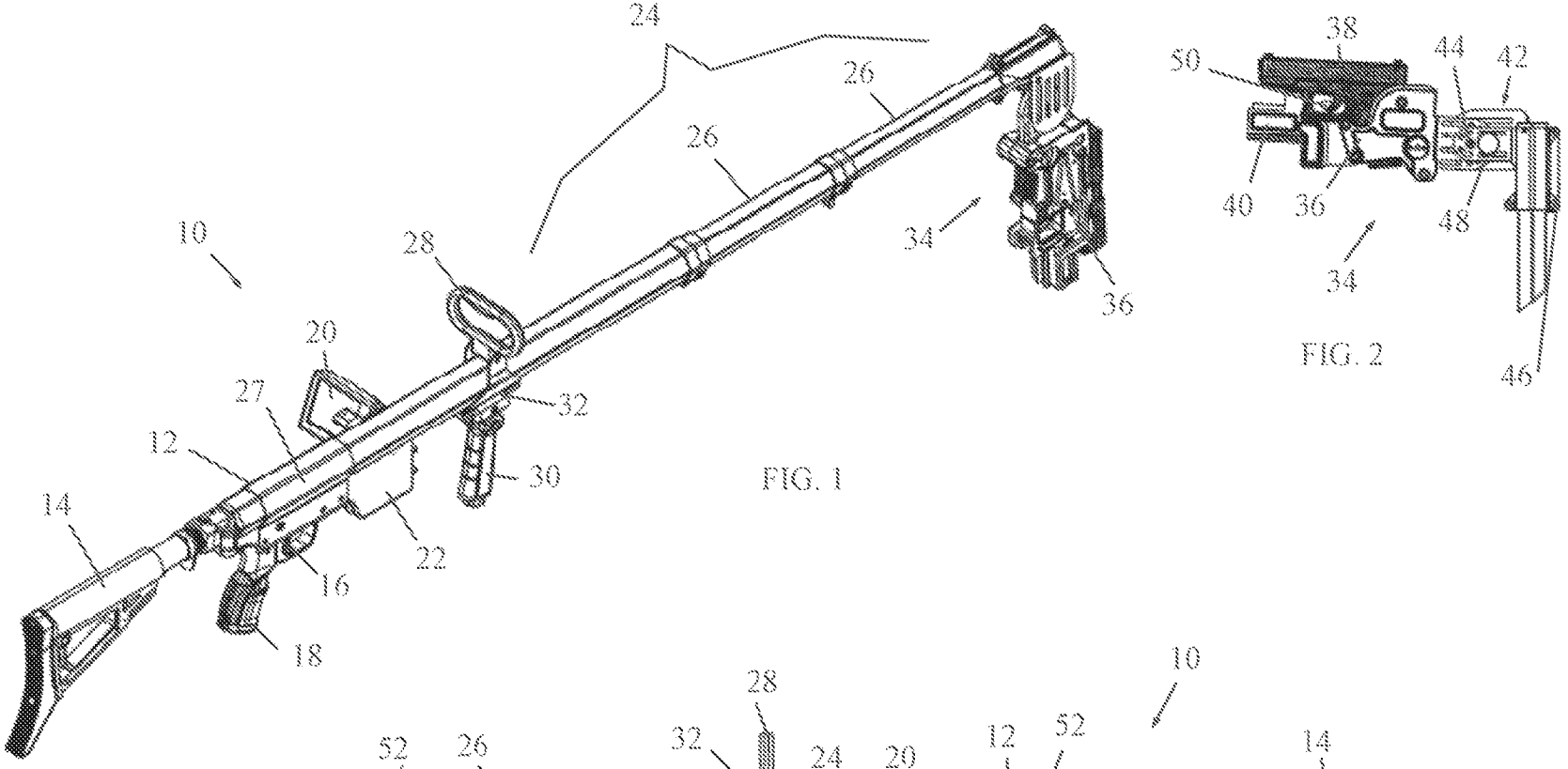
FIG. 1
FIG. 2
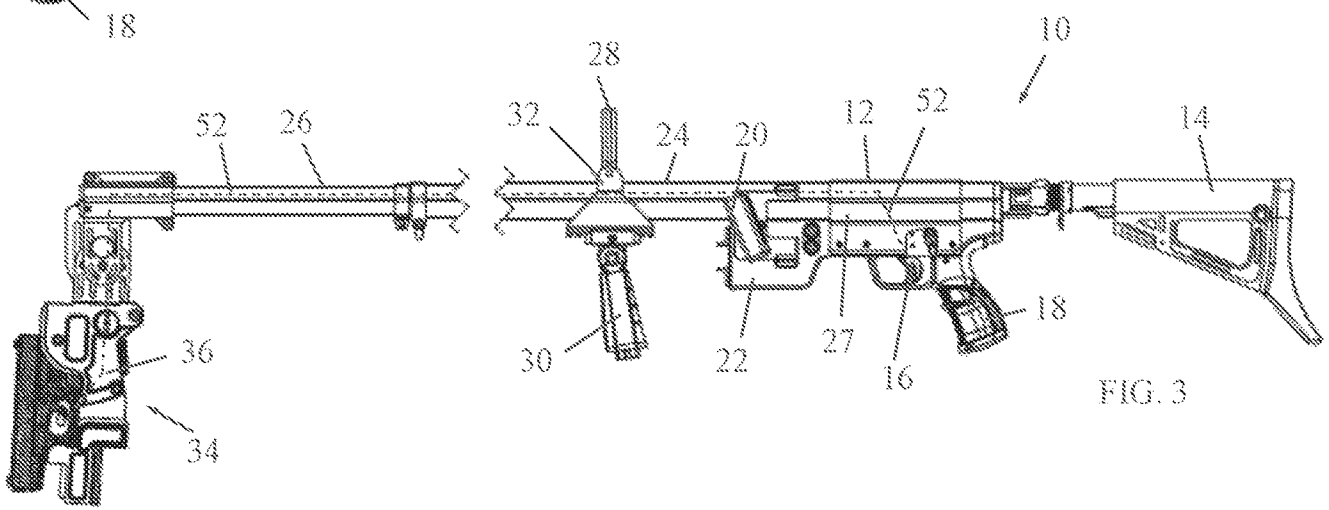
FIG. 3

VARIABLE-LENGTH CORNER SHOOTING ASSEMBLY

FIELD OF THE INVENTION

The present invention relates to firearms in general and, in particular, to an assembly for shooting around corners.

BACKGROUND OF THE INVENTION

In many cases, it would be desirable to shoot and hit a target lying at an angle to, or around a corner from, a person firing a weapon, such as a handgun or rifle and the like. With conventional firearms, this is impossible, since the barrel is straight and can only be fired forwards or backwards, or else the weapon must be held extended from the body and fired without visually aiming towards the target.

U.S. Pat. No. 6,543,173, assigned to the same assignee as the present application, describes a firearm assembly that permits firing around a corner at a target. In one embodiment, U.S. Pat. No. 6,543,173 describes a firearm assembly comprising a support stock with a stock trigger. A pivotal connector pivotally connects a firearm to the support stock at any desired angle. A trigger connector couples the stock trigger to the trigger of the firearm for remote firing of the firearm.

SUMMARY OF THE INVENTION

The present invention seeks to provide a corner shooting assembly, in which the distance between the shooter and the firearm is variable.

There is thus provided in accordance with a non-limiting embodiment of the present invention an assembly including a receiver body including a butt, a body trigger, a grip, and a display screen, and a variable-length shaft extending from a front portion of the receiver body, a firearm receiver member coupled to a distal end of the variable-length shaft by means of a coupling device, and a camera in communication with, and configured to send images to, the display screen.

In accordance with a non-limiting embodiment of the present invention the variable-length shaft includes telescoping sections which are movable axially with respect to each other to increase or decrease an overall length of the variable-length shaft.

In accordance with a non-limiting embodiment of the present invention the telescoping sections are manually movable. Alternatively, the telescoping sections are movable by a motorized device housed in the receiver body. The receiver body may include a control unit.

In accordance with a non-limiting embodiment of the present invention the coupling device includes a bracket with one end secured to the variable-length shaft and another end secured to the firearm receiver member.

In accordance with a non-limiting embodiment of the present invention the coupling device includes a pivot joint so that the firearm receiver member is pivotable to any desired angle with respect to the variable-length shaft.

In accordance with a non-limiting embodiment of the present invention a firearm has a firearm trigger which is coupled with the body trigger.

BRIEF DESCRIPTION OF THE DRAWINGS

The present invention will be understood and appreciated more fully from the following detailed description taken in conjunction with the drawings in which:

FIG. 1 is a simplified perspective illustration of a corner shooting assembly, in accordance with a non-limiting embodiment of the present invention;

FIG. 2 is a simplified perspective illustration of a firearm holding assembly which is part of the corner shooting assembly, in accordance with a non-limiting embodiment of the present invention; and FIG. 3 is a simplified side-view illustration of the corner shooting assembly.

DETAILED DESCRIPTION OF EMBODIMENTS

Reference is now made to FIGS. 1-3, which illustrate a corner shooting assembly 10, in accordance with a non-limiting embodiment of the present invention.

The corner shooting assembly 10 includes a receiver body 12 and a butt 14 coupled to the rear portion of the body 12, such as by pivoted connection. The receiver body 12 includes a body trigger 16, a grip 18, and a display screen 20. The receiver body 12 may also include a control unit 22, which controls different functions of the corner shooting assembly 10 described below.

A variable-length shaft 24 extends from the front portion of the receiver body 12. The variable-length shaft 24 may include telescoping sections 26 that can move axially with respect to each other to increase or decrease the overall length of the variable-length shaft 24. The telescoping sections 26 may be moved in and out of each other manually or alternatively by a motorized device 27 housed in receiver body 12 and controlled by control unit 22. Alternatively, the variable-length shaft 24 may include coiled sections, spring-loaded sections or other mechanisms for increasing or decreasing the overall length of the variable-length shaft 24.

A carrying handle 28 and a foregrip 30 may be affixed to variable-length shaft 24 or receiver body 12. In the non-limiting illustrated embodiment, carrying handle 28 and foregrip 30 are coupled to an attachment member 32 which is fastened to variable-length shaft 24 or receiver body 12. The foregrip 30 may be pivotable with respect to variable-length shaft 24 or receiver body 12.

At the distal end of the variable-length shaft 24 ("distal" meaning the end farthest from the butt, the butt being at the proximal end of the assembly) is a firearm holding assembly 34, which is shown also in FIG. 2. The firearm holding assembly 34 includes a firearm receiver member 36 for fixedly receiving therein a firearm 38. The firearm receiver member 36 may include fasteners (such as but not limited to, clasps, clips, quick-disconnect connectors, and the like) for securing thereto the firearm 38. A camera 40 may be disposed on firearm receiver member 36, which may be aligned with, or processed to view, the line of sight of the bore of firearm 38. The camera 40 is in communication with display screen 20 and sends images to display screen 20. Alternatively, camera 40 may be mounted on firearm 38 or to the side of firearm 38 or any other suitable position (not even on the assembly, such as a remote camera from a global positioning system) that permits the shooter at the proximal end of the assembly to see the target.

The firearm receiver member 36 may be coupled to the distal end of the variable-length shaft 24 by means of a coupling device 42. The coupling device 42 may be a bracket with one end secured to the distal end of the variable-length shaft 24 and the other end secured to firearm receiver member 36. Alternatively, coupling device 42 may include a pivot joint 44 so that firearm receiver member 36 is pivotable to any desired angle with respect to the distal end of the variable-length shaft 24. In this alternative, one or more control wires 46 may be provided with one end coupled to firearm receiver member 36 and the other end of the wire coupled to a control member near the shooter's hand. For example, the foregrip 30 may serve as the control member to control the pivoting of firearm receiver member 36 with respect to the variable-length shaft 24, or a separate, dedicated control member on the assembly may be provided for this purpose. As another alternative, a motor or other actuator 48 may be mounted near the firearm receiver member 36 which rotates firearm receiver member 36 about the pivot joint 44. The motor 48 may be operated by remote control or by wireless communication by the control unit 22 (for example, with suitable control buttons or touch screen).

The firearm 38 has a firearm trigger 50 which is coupled with body trigger 16, such as by a wire 52 (shown in broken lines in FIG. 3) that connects the two triggers together. The wire may extend the length of the assembly between the two triggers either inside or outside the variable-length shaft 24. Alternatively, a telescoping rod or like member may be provided in variable-length shaft 24 with a proximal end coupled to body trigger 16 (such as by a short wire) and a distal end coupled to firearm trigger 50 (such as by a short wire). As another alternative, a motor or other actuator may be mounted near firearm trigger 50 and remotely controlled (such as by body trigger 16 which would be an electric switch) to actuate the trigger 50 and operate the firearm 38.

Other tactical equipment may be mounted on firearm holding assembly 34, such as but not limited to, a flashlight, laser scope and others. The firearm holding assembly 34 may include a Picatinny rail for mounting such items.

In use, the shooter moves out as many telescoping sections 26 as needed to reach a particular vertical height or horizontal distance. Camera 40 is used to sight the target which is displayed to the shooter on display screen 20. Actuating the body trigger 16 actuates the firearm trigger 50 and shoots a projectile from the firearm 38. The firearm receiver member 36 may be pivoted with respect to the variable-length shaft 24 to shoot at different angles.

What is claimed is:

1. An assembly (10) comprising:

a receiver body (12) comprising a butt (14), a body trigger (16), a grip (18), and a display screen (20); and a variable-length shaft (24) extending from a front portion of said receiver body (12), a firearm receiver member (36) coupled to a distal end of said variable-length shaft (24) by means of a coupling device (42), and a camera (40) in communication with, and configured to send images to, said display screen (20).

2. The assembly (10) according to claim 1, wherein said variable-length shaft (24) comprises telescoping sections (26) which are movable axially with respect to each other to increase or decrease an overall length of said variable-length shaft (24).

3. The assembly (10) according to claim 2, wherein said telescoping sections (26) are manually movable.

4. The assembly (10) according to claim 2, wherein said telescoping sections (26) are movable by a motorized device (27) housed in said receiver body (12).

5. The assembly (10) according to claim 1, wherein said receiver body (12) comprises a control unit (22).

6. The assembly (10) according to claim 1, wherein said coupling device (42) comprises a bracket with one end secured to said variable-length shaft (24) and another end secured to said firearm receiver member (36).

7. The assembly (10) according to claim 1, wherein said coupling device (42) comprises a pivot joint (44) so that said firearm receiver member (36) is pivotable to any desired angle with respect to said variable-length shaft (24).

8. The assembly (10) according to claim 1, further comprising a firearm (38) that has a firearm trigger (50) which is coupled with said body trigger (16).

* * * * *